US008875642B2

(12) United States Patent
Kawai

(10) Patent No.: US 8,875,642 B2
(45) Date of Patent: Nov. 4, 2014

(54) SEWING MACHINE

(71) Applicant: Aisin Seiki Kabushiki Kaisha, Kariya (JP)

(72) Inventor: Yasunori Kawai, Nagoya (JP)

(73) Assignee: Aisin Seiki Kabushiki Kaisha, Kariya-shi (JP)

( * ) Notice: Subject to any disclaimer, the term of this patent is extended or adjusted under 35 U.S.C. 154(b) by 0 days.

(21) Appl. No.: 14/178,613

(22) Filed: Feb. 12, 2014

(65) Prior Publication Data

US 2014/0238286 A1 Aug. 28, 2014

(30) Foreign Application Priority Data

Feb. 25, 2013 (JP) ..... 2013-034712

(51) Int. Cl.
*D05B 47/04* (2006.01)
*D05C 11/08* (2006.01)

(52) U.S. Cl.
CPC ..... *D05B 47/04* (2013.01); *D05C 11/08* (2013.01)
USPC ..... 112/254

(58) Field of Classification Search
CPC ..... D05C 11/05; D05C 11/10; D05B 47/00; D05B 47/02; D05B 47/04
USPC ..... 112/302, 254, 255, 273, 278
See application file for complete search history.

(56) References Cited

U.S. PATENT DOCUMENTS

| | | | | |
|---|---|---|---|---|
| 1,581,093 | A * | 4/1926 | Howie | 66/99 |
| 3,721,205 | A * | 3/1973 | Ono et al. | 112/254 |
| 6,055,920 | A * | 5/2000 | Hori | 112/443 |
| 6,145,457 | A | 11/2000 | Imaeda et al. | |
| 8,286,569 | B2 | 10/2012 | Nishiyama et al. | |
| 8,479,672 | B2 | 7/2013 | Kawai | |
| 2011/0290168 | A1 | 12/2011 | Kawai | |
| 2012/0006241 | A1 * | 1/2012 | Nishiyama et al. | 112/221 |

FOREIGN PATENT DOCUMENTS

| | | |
|---|---|---|
| DE | 19951127 A1 | 5/2001 |
| DE | 10063002 A1 | 8/2001 |
| EP | 2412858 A1 | 2/2012 |
| JP | 2000-202182 | 7/2000 |
| JP | 2011-245110 | 12/2011 |
| JP | 2013-123606 | 6/2013 |
| WO | WO 2010/109773 | 9/2010 |

OTHER PUBLICATIONS

European Search Report issued on Jul. 10, 2014 in European Patent Application No. EP 14 15 6592.

* cited by examiner

*Primary Examiner* — Danny Worrell
(74) *Attorney, Agent, or Firm* — Oblon, Spivak, McClelland, Maier & Neustadt, L.L.P.

(57) ABSTRACT

A sewing machine includes: a needle rod being reciprocated vertically; tension discs sandwiching an upper thread; a feed mechanism transporting a sewing object in a vertical direction; a reciprocating mechanism reciprocating the needle rod laterally; an upper thread tension adjusting mechanism adjusting the tension discs; a feed amount adjusting mechanism adjusting a feed amount of the feed mechanism; a stitch width adjusting mechanism adjusting a stitch width of the reciprocating mechanism; and a control apparatus controlling the upper thread tension adjusting mechanism, the feed amount adjusting mechanism, and/or the stitch width adjusting mechanism. A common adjusting mechanism, being one of the feed amount adjusting mechanism and the stitch width adjusting mechanism, includes: a motor; an adjusting mechanism body being a tooth-missing gear and/or a cam; and a variation amount adjusting unit. The upper thread tension adjusting mechanism includes: a thread loosening portion; and an upper thread tension adjusting unit.

4 Claims, 11 Drawing Sheets

SEWING MACHINE

CROSS REFERENCE TO RELATED APPLICATIONS

This application is based on and claims priority under 35 U.S.C. §119 to Japanese Patent Application 2013-034712, filed on Feb. 25, 2013, the entire contents of which are incorporated herein by reference,

TECHNICAL FIELD

This disclosure relates to a sewing machine, specifically to a sewing machine having an embroidery function,

BACKGROUND DISCUSSION

In the related art, there is a sewing machine configured to do a sewing such as embroidery (hereinafter, referred to as "free-motion sewing") at a given position and in a direction on a sewing object by moving the sewing object freely. In order to do embroidery or the like at an arbitrary position, a mechanism to move the sewing object arbitrarily is necessary. An upper thread is connected to the sewing object in a course of doing embroidery. Generally, in the sewing machine, a structure in which the upper thread is constantly tensed is used, and moving the sewing object against the tension is not comfortable.

Accordingly, a mechanism for releasing the tension of the upper thread manually when moving the sewing object is provided. However, in view of an improvement of convenience and prevention of forgetting of tension restoration, automation of release of the tension of upper thread is required.

For example, in WO2010/109773 (Reference 1), as a user assistance function in the free-motion sewing using a computer sewing machine, a stitching width can be adjusted in accordance with a pressing amount of a foot controller and, in addition, the tension of the upper thread is automatically released without operating a holder lift lever when the sewing machine is stopped. When the foot controller is pressed, the tension of the upper thread is automatically restored.

Since a resistance force caused by the tension of the upper thread is not generated when a user moves a process fabric during embroidery, the user is allowed to work with comfort without any stress. In order to realize the above-described function, an electric actuator configured to open and close a tension disc is controlled.

However, since the sewing machine of Reference 1 has a structure of the general computer sewing machine added with an "upper thread tension adjusting mechanism" composed of the electric actuator, increase in manufacture cost of a sewing machine body and increase in weight of the product are resulted.

SUMMARY

Thus, a need exists for a sewing machine which is not suspectable to the drawback mentioned above.

(1) An aspect of this disclosure is directed to a sewing machine including: a needle rod on which a needle is mountable and configured to be reciprocated vertically; a pair of tension discs configured to sandwich an upper thread therebetween; a feed mechanism configured to transport a sewing object in a vertical direction; a reciprocating mechanism configured to reciprocate the needle rod laterally with respect to the vertical direction; an upper thread tension adjusting mechanism configured to adjust the tension discs by switching between an open state in which the tension of the upper thread is released, and a restored state in which the tension is restored; a feed amount adjusting mechanism configured to adjust a feed amount of the feed mechanism; a stitch width adjusting mechanism configured to adjust a stitch width of the reciprocating mechanism; and control means configured to control the upper thread tension adjusting mechanism, the feed amount adjusting mechanism, and/or the stitch width adjusting mechanism, wherein a common adjusting mechanism, which is one of the feed amount adjusting mechanism and the stitch width adjusting mechanism, includes; a motor; an adjusting mechanism body which is a tooth-missing gear whose teeth are partially missing and/or a cam and configured to be driven by the motor; a variation amount adjusting unit configured to change the variation amount, which is the feed amount of the feed mechanism or the stitch width of the reciprocating mechanism within a first range which is part of a movable range of the adjusting mechanism body by either one of a driven gear that engages the teeth of the tooth-missing gear or a driven member pushed by a cam surface of the cam, the upper thread tension adjusting mechanism includes: a thread loosening portion engaging the tooth-missing gear or pressed by the cam surface within a second range deviated from the first range in the adjusting mechanism body; and an upper thread tension adjusting unit configured to switch the tension discs from the restored state to the open state in conjunction with the thread loosening portion, and the control means performs an opening action that switches the tension discs to the open state by changing the adjusting mechanism body in the second range when the common adjusting mechanism does not have to perform an adjustment of the variation amount, and when the tension disc needs to be opened.

Simplification of the adjusting mechanism which is a principal cause of an increase in cost or number of components is succeeded. Specifically, the function of the upper thread tension adjusting mechanism is integrated with one of the feed amount adjusting mechanism and the stitch width adjusting mechanism. When the upper thread tension adjusting mechanism is operated, the operations of the feed amount adjusting mechanism and the stitch width adjusting mechanism may be avoided, so that the both may be controlled independently even though they are integrated.

The sewing machine of this disclosure needs not to have a motor specific for the upper thread tension adjusting mechanism by having the configuration described above, so that a reduction in cost may be realized.

BRIEF DESCRIPTION OF THE DRAWINGS

The foregoing and additional features and characteristics of this disclosure will become more apparent from the following detailed description considered with the reference to the accompanying drawings, wherein:

FIGS. 5A and 5B are schematic drawings illustrating a state of an operation of the stepping motor drive unit of the sewing machine of Embodiment 1, wherein FIG. 5A shows a state in which a needle is at a right-drop position, and FIG. 5B shows a state in which the needle is at a left-drop position;

FIGS. 6A and 6B are schematic drawings illustrating a state of the operation of the stepping motor drive unit of the sewing machine of Embodiment 1 wherein FIG. 6A shows a state in which transmission of a drive force to the upper thread tension adjusting mechanism is started, and FIG. 6B shows a state in which a tension of the upper thread is released;

FIGS. 10A and 10B are schematic drawings illustrating a state of the operation of the stepping motor drive unit of the sewing machine of Embodiment 2, wherein FIG. 10A shows a reverse feed state, and FIG. 10B shows a forward feed state;

FIGS. 11A and 11B are schematic drawings illustrating a state of the operation of the stepping motor drive unit of the sewing machine of Embodiment 2, wherein FIG. 11A shows a state in which transmission of a drive force to the upper thread tension adjusting mechanism is started, FIG. 11B shows a state in which a tension of the upper thread is released;

DETAILED DESCRIPTION

Referring now to FIG. 1 to FIG. 13, representative embodiments will be described. A sewing machine according to embodiments described here is a sewing machine which allows a free-motion sewing. Since there is a request to release a tension of an upper thread at the time of normal sewing, the sewing machine of the embodiments described here does not necessarily have to be a sewing machine having a free-motion sewing function. In this specification, the term "free-motion sewing" means a state in which the position of sewing can be changed freely. The state that is realized specifically at the time of free-motion sewing means that the tension discs are automatically opened to release the tension of the upper thread is when the machine is stopped, and also the tension discs are automatically closed to restore the tension of the upper thread at the time of start of the sewing machine. In this specification, up, down, left, right, front, and rear directions represent the direction with respect to a user in a state of usage of the sewing machine. For example, in FIG. 1, the direction X1 indicates a rightward direction, X2 indicates a leftward direction, a nearer direction on a paper plane with respect to X1-X2 represents the front direction, a direction opposite thereto represents a rearward direction, up indicates an upward direction, and down indicates a downward direction.

Embodiment 1

The sewing machine of Embodiment 1 has a structure that transmits a drive force of a "stitch width adjusting mechanism" to an "upper thread tension adjusting mechanism" only when necessary. Since the "stitch width adjusting mechanism" and the "upper thread tension adjusting mechanism" do not have to be driven at the same time, the two mechanisms may be driven by a single stepping motor.

Figure 1:
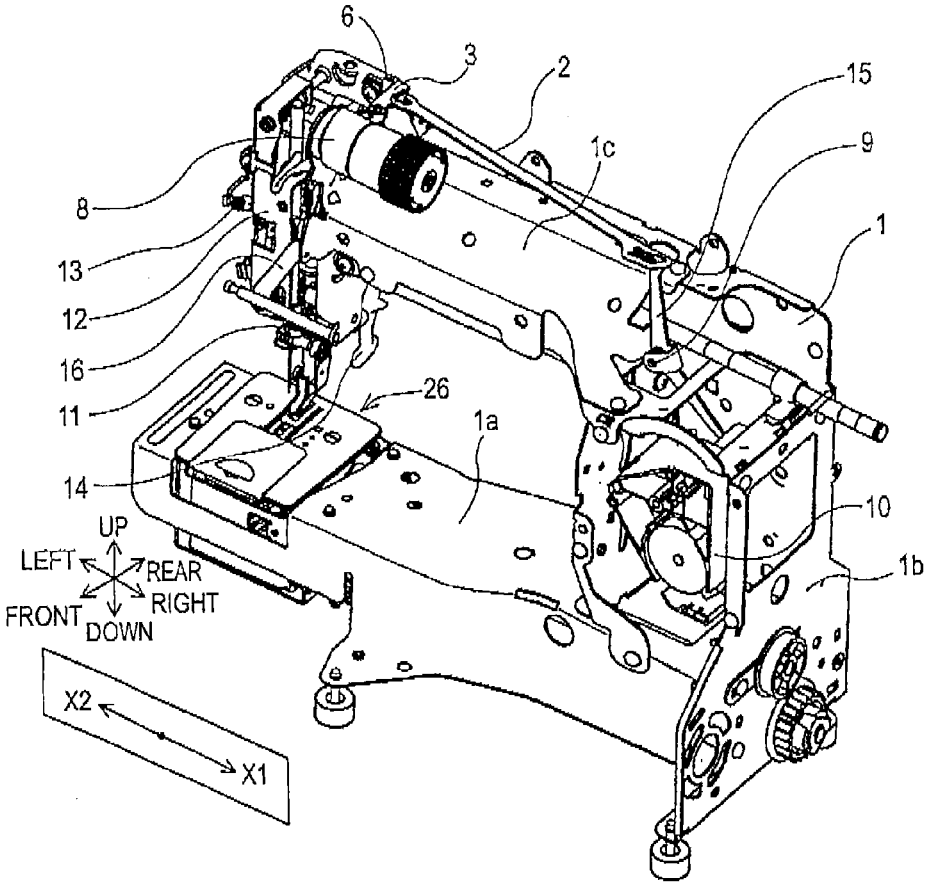
FIG. 1 is a schematic drawing illustrating an internal configuration of a sewing machine of Embodiment 1.

An internal structure of the sewing machine of Embodiment 1 includes a sewing machine frame 1 and members fixed to the sewing machine frame 1 as illustrated in FIG. 1. The sewing machine frame 1 constitutes a frame body of the sewing machine of Embodiment 1, and includes a bed portion 1*a* positioned on the lower side, a sewing machine body portion 1*b* extending upright from a right portion of the bed portion 1*a*, and an arm portion 1*c* extending leftward from an upper portion of the sewing machine body portion 1*b*.

A feed mechanism 26 is disposed on a left portion of the bed portion 1*a*, and a drive motor (which is not illustrated) is disposed on the right portion. The sewing machine body portion 1*b* includes a stepping motor drive unit 10 (common adjusting mechanism) disposed thereon. A needle rod 11 is disposed on the left portion of the arm portion 1*c* so as to move upward and downward. The needle rod 11 is held so as to be embraced by a needle rod arm 12 mounted on the left portion of the arm portion 1*c* so as to be capable of swinging. The upward and downward movement of the needle rod 11 is performed synchronously with the action of the feed mechanism 26 by a rotational power distributed from the above-described motor. An upper thread tension application mechanism 8 configured to apply a tension to an upper thread supplied to a needle fixed to the needle rod 11 is disposed above the needle rod 11.

Figure 2:
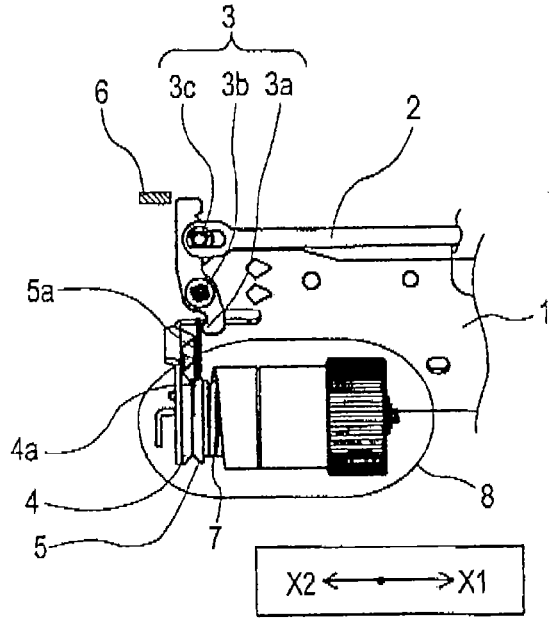
FIG. 2 is a schematic drawing of an upper thread tension adjusting mechanism of the sewing machine of Embodiment 1.

The upper thread tension application mechanism 8 includes a pair of tension discs 4 and 5 configured to place the upper thread therebetween, and a tension spring 7 configured to urge and press the tension disc 4 and 5 in the direction of placing one on top of another as illustrated in FIG. 2. A thread loosening member 3 is assembled to the sewing machine frame 1 so as to rotate about center of rotation 3*b* as a mechanism for releasing the upper thread tension when the user operates a holder lift lever 14 or by the stepping motor drive unit 10 (upper thread tension adjusting mechanism), described later.

When the user moves the holder lift lever 14 upward in a normal usage state (a state in which a tension is applied to the upper thread), a thread loosening lever 6 moves in the direction X1, and presses a rear end of the thread loosening member 3, so that the thread loosening member 3 rotates in a clockwise direction when viewed downward from above. A contact finger 3*a* of the rotated thread loosening member 3 presses a working arm 5*a* of the tension disc 5 (right), and the left and right tension discs 4 and 5 release the upper thread tension by opening in a V shape with respect to a supporting point 4*a* only on lower sides against the load of the tension spring 7. In contrast, when the user moves the holder lift lever 14 downward, a reverse movement occurs, and the tension discs 4 and 5 are closed by a load of the tension spring 7 and the upper thread tension is restored.

In a case where the user selects a free-motion sewing mode, a stepping motor of the stepping motor drive unit 10 is controlled by a microcomputer integrated in the sewing machine, and a procedure of opening the left and right tension discs 4 and 5 to release the upper thread tension when the sewing machine is stopped, and closing the tension discs 4 and 5 to restore the upper thread tension when the sewing machine is activated is automated. Specifically, a thread loosening rod 2 connected to a rod connecting portion 3*c* of the thread loosening member 3 so as to be pivotable is provided, and the thread loosening member 3 rotates (clockwise) about the center of rotation 3*b* by the movement of the thread loosening rod 2 in the direction X1, whereby the tension discs 4 and 5 are opened to release the upper thread tension, A reciprocating mechanism configured to reciprocate the needle rod 11 leftward and rightward (direction X1-X2) in a zigzag stitch or the like is provided. The reciprocating mechanism includes a stitch width rod 16 configured to adjust an amplitude of the needle rod 11. The stitch width rod 16 adjusts an amount of pulling the needle rod arm 12 that embraces the needle rod 11 (the stitch width: the mechanism is not illustrated) in the direction X1 by change in the position in the direction X1-X2. The pulled needle rod arm 12 is pulled in the direction X2 by a needle rod arm returning spring (tension spring) 13. In other words, by moving the stitch width rod 16 in the direction X1-X2 (by adjusting the amount of pulling in the direction X1), the amplitude of the reciprocal movement of the needle rod 11 may be controlled.

Figure 3:
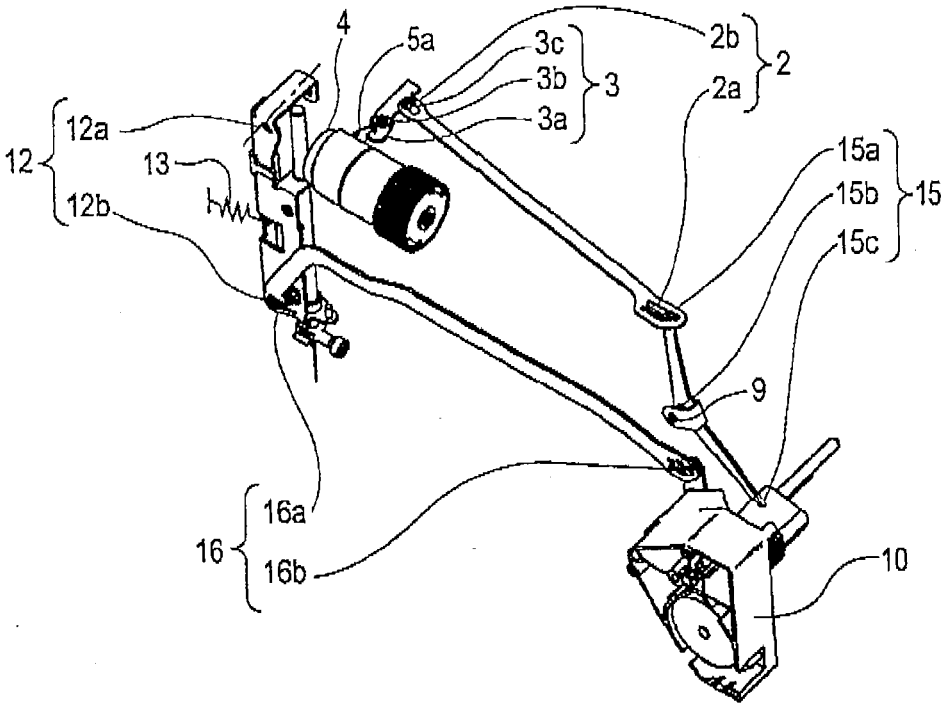
FIG. 3 is a schematic drawing illustrating a relationship among a common adjusting mechanism, the upper thread tension adjusting mechanism, and a stitch width adjusting mechanism of the sewing machine of Embodiment 1.

The thread loosening rod 2 and the stitch width rod 16 are pulled by the stepping motor drive unit 10, and controls the upper thread tension adjusting mechanism and the reciprocating mechanism. The stepping motor drive unit 10 will be described below. As illustrated in FIG. 3, an end 15*a* of a thread loosening lever is connected to an end 2*a* of a thread loosening rod in a state having a minute play. A center of rotation 15*b* of the thread loosening lever is assembled to a shaft 9 fixed to the sewing machine frame 1 in a rotatable state. An end portion 16*b* of the stich width rod is connected to an end portion 20*a* (see FIGS. 4A and 4B) of the stitch width lever 20 in a state having a minute play.

Figure 4B:
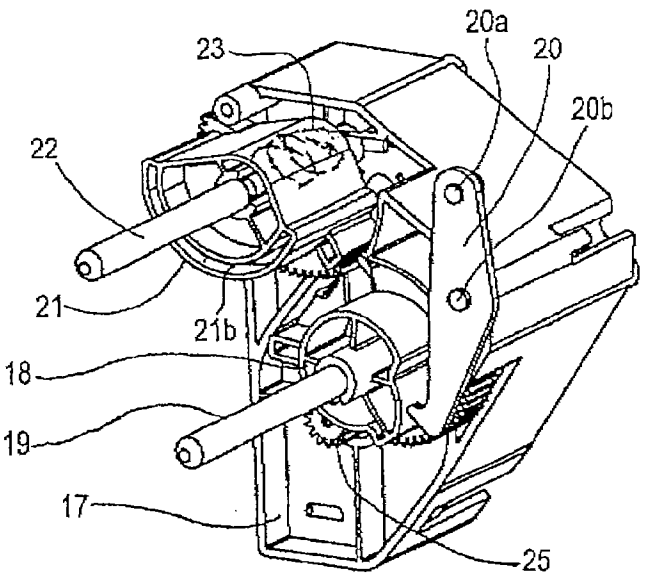
FIGS. 4A and 4B are schematic drawings illustrating a configuration of a stepping motor drive unit of the sewing machine of Embodiment 1.
Figure 4A:
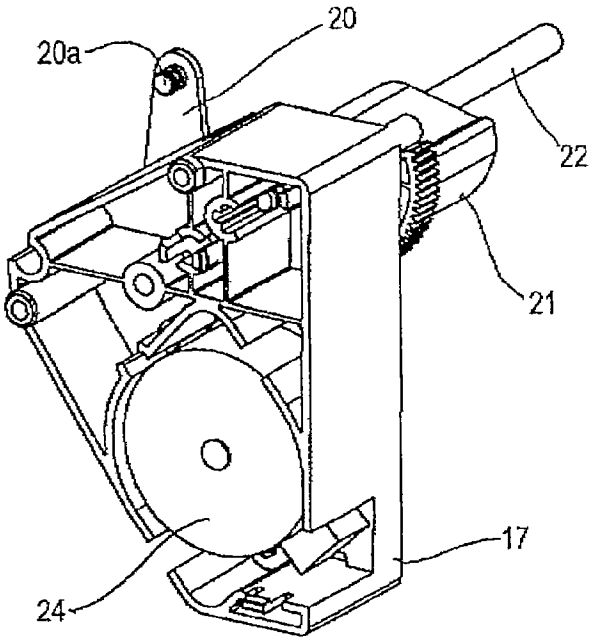

As illustrated in FIGS. 4A and 4B, the stepping motor drive unit 10 is unified. A stepping motor 24 having a pinion gear 25 press-fitted to a bracket 17 is fixed. A shaft 19 and a shaft 22 are fixed to the bracket 17, and a common gear 18 (which corresponds to an adjusting mechanism body composed of a tooth-missing gear and a cam combined with each other) having a gear portion 18*b* and a tooth-missing part is assembled to the shaft 19, and a thread loosening gear 21 (which corresponds to a thread loosening portion) is rotatably assembled to the shaft 22 respectively. A contact finger 20*c* of a stitch width lever 20 is rotatably assembled to the bracket 17 at a position where the stitch width lever 20 is allowed to always come into contact with the cam portion 18*b* of the common gear 18. A contact finger 15*c* (see FIGS. 5A and 5B) of the thread loosening lever always comes into contact with a cam portion 21*b* of the thread loosening gear 21.

A return spring (torsion coil spring) 23 is assembled on a center axis of rotation in the thread loosening gear 21, and one of the arms is fixed into the thread loosening gear 21 and the other arm is fixed to the bracket 17. The thread loosening gear 21 is urged by the return spring 23 (clockwise in FIGS. 5A and 5B).

Figure 5B:
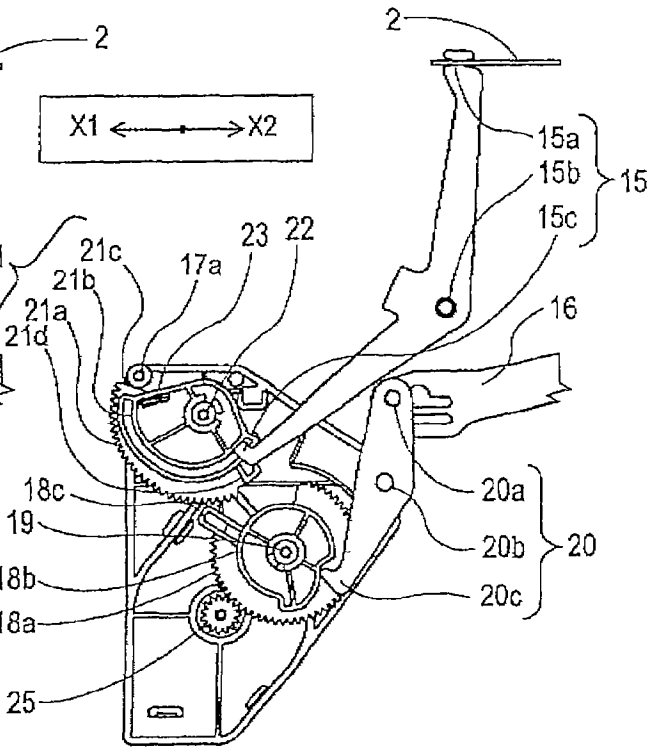
Figure 5A:
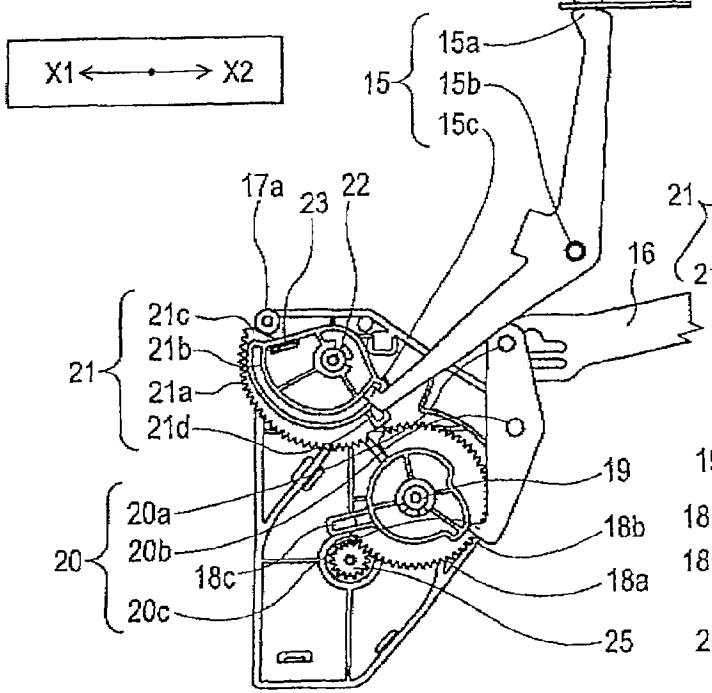

With reference to FIGS. 5A and 5B, the "stitch width adjusting mechanism" in the state of being used in normal sewing of the sewing machine of the embodiment disclosed here will be described. The pinion gear 25 and a gear portion 18*a* of the common gear 18 are always kept in an engaged state, and the drive power of the stepping motor 24 is transmitted and amplified. The gear portion 18*a* of the common gear 18 and a gear portion 21*a* of the thread loosening gear 21 are in an engaging positional relationship. However, since the common gear 18 has teeth only on part of an outer periphery thereof, part of the gear portion 18*a* engages the gear portion 21*a* neither in a state where the needle is at the right-drop position in the normal sewing (FIG. 5A: a state in which the needle rod arm 12 is moved to an extremity in the direction X1 (rightward direction) in FIG. 1. A limit in the direction X1 (rightward direction) within a movable range of the needle rod arm 12 in the direction X1-X2) nor in a state where the needle is at the left-drop position (FIG. 5B: a state in which the needle rod arm 12 is moved to an extremity in the direction X2 (leftward direction) in FIG. 1. A limit in the direction X2 (leftward direction) within the movable range of the needle rod arm 12 in the direction X1-X2) (this range corresponds to a first range. The first range is a range where the gear portion 18*a* of the common gear 18 and the gear portion 21*a* of the thread loosening gear 21 do not engage each other. In other words, the first range is a range in which the movement of the common gear 18 is not transmitted to the thread loosening gear 21 since the portion of the common gear 18 where the gear portion 18*a* is missing (tooth-missing) is positioned at the gear portion 21*a* of the thread loosening gear 21. A second range is a range where the gear portion 18*a* of the common gear 18 and the gear portion 21*a* of the thread loosening gear 21 engage each other. In other words, the second range is a range in which the movement of the common gear 18 is transmitted to the thread loosening gear 21 since the gear portion 18*a* of the common gear 18 is positioned at the gear portion 21*a* of the thread loosening gear 21.). As a matter of course, the gear portion 18*a* of the common gear 18 and the gear portion 21*a* of the thread loosening gear 21 do not engage each other irrespective of the position of the needle rod arm 12 as long as the needle rod arm 12 is positioned between the right-drop position and the left-drop position.

In these states, the thread loosening gear 21 rotates clockwise by a rotational torque of the return spring 23, and a state in which a surface 21*c* is in contact with a stopper 17*a* of the bracket 17 and hence is stopped is maintained.

Figure 7:
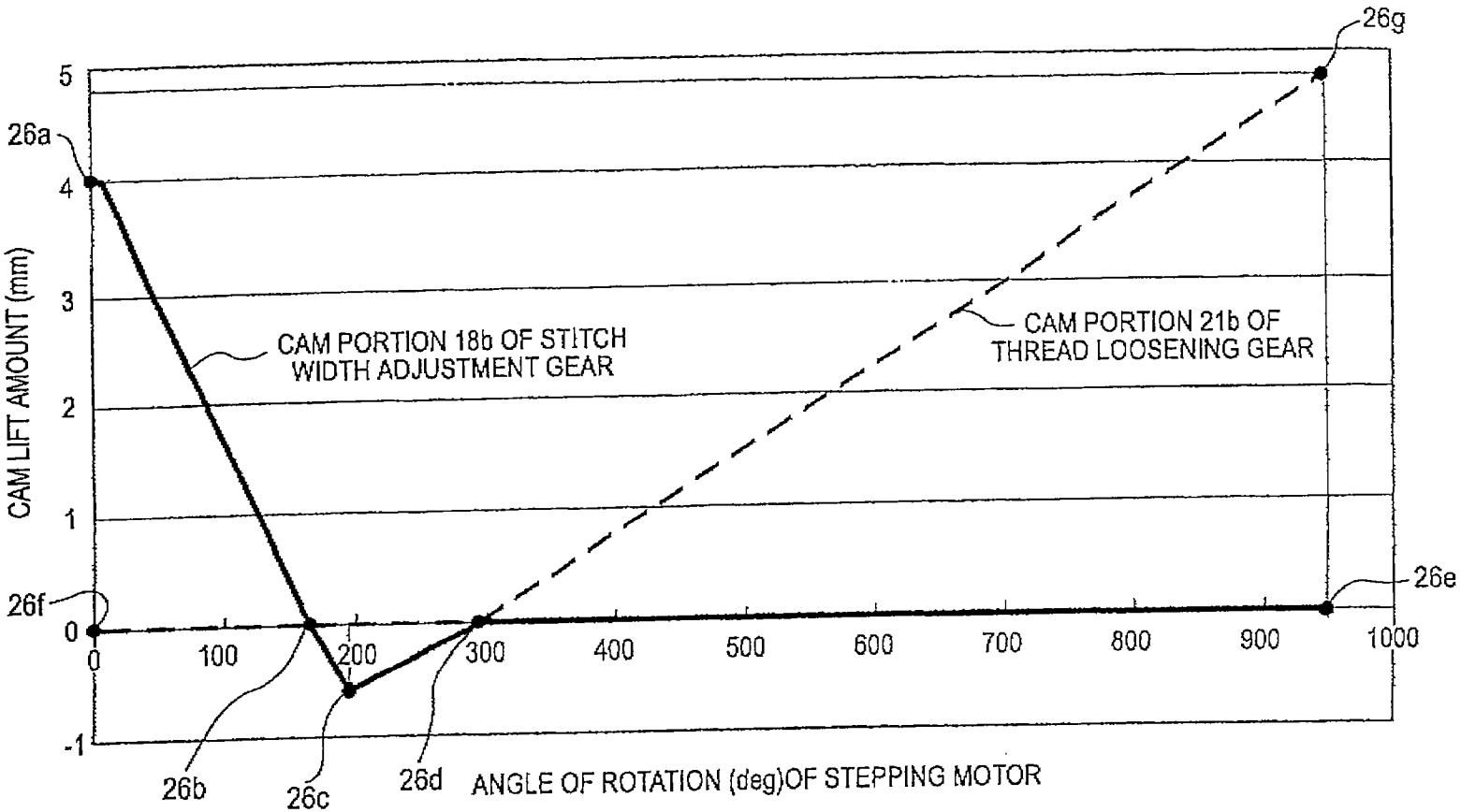
FIG. 7 is a graph showing a cam lift amount of a cam portion of the sewing machine of Embodiment 1.

In contrast, since the stitch width rod 16 is always pulled in the direction X2 by an action of the needle rod arm returning spring 13, the stitch width lever 20 rotates clockwise about 20*b*, and the state in which the contact finger 20*c* is in contact with the cam portion 18*b* of the common gear 18 is maintained. Assuming that the rotational angle of the shaft portion (the pinion gear 25) of the stepping motor 24 at the right-drop position is 0°, the cam lift amount of the cam portion 18*b* of the common gear 18 is a value of 26*a* (a maximum value, 4 mm) in FIG. 7, and a value of a load applied on the shaft portion of the stepping motor 24 by the action of the needle rod arm returning spring 13 is maximized. When the shaft portion of the stepping motor 24 (the pinion gear 25) rotates by approximately 160° from this state, the cam portion 18*b* of the common gear 18 rotates correspondingly, and the cam lift amount changes approximately linearly to a value of 26*b* (0 mm) in FIG. 7 and the state is changed to a left-drop position. During this period, the needle rod arm 12 (see FIG. 3) rotates in the direction X2 about 12*a* by the action of the needle rod arm returning spring 13, and the stitch width rod 16 is pulled in the direction X2 and hence the stitch width lever 20 rotates clockwise about 20*b*, whereby the state in which the contact finger 20*c* is in contact with the cam portion 18*b* of the common gear 18 is maintained. The value of the load on the shaft portion of the stepping motor 24 by the action of the needle rod arm returning spring 13 is minimized. In other words, translation from the right-drop position to the left-drop position is quickly achieved by rotating the common gear 18 clockwise. In FIG. 7, a segment where the cam lift amount of the cam portion 18*b* of the common gear 18 is changed from 26*b* to 26*c* in a minus direction is an adjustment margin which allows an adjustment when the stop accuracy of the shaft portion of the stepping motor 24 is varied at the time of mass-production.

An operation of the "upper thread tension adjusting mechanism" when the sewing machine in the free-motion sewing mode is stopped will be described. When the user stops the sewing machine by returning the foot controller, the shaft portion of the stepping motor 24 (the pinion gear 25) rotates to a position 26*e* or 26*g* in FIG. 7 (approximately 950°). A position 26*d* (approximately 290°) in this process corresponds to FIG. 6A, and the lever portion 18*c* of the common gear 18 rotated clockwise from the left-drop position in FIG. 5B comes into contact with the lever portion 21*d* of the thread loosening gear 21 at the position 26*d*. Furthermore, the common gear 18 rotates clockwise, and hence the lever portion 18*c* presses the lever portion 21*d* of the thread loosening gear 21 and the thread loosening gear 21 rotates counterclockwise, in time, the gear portion 18*a* of the common gear 18 and the gear portion 21*a* of the thread loosening gear 21 engage, and the drive force of the stepping motor 24 is transmitted via two steps of a spur gear.

Figure 6B:
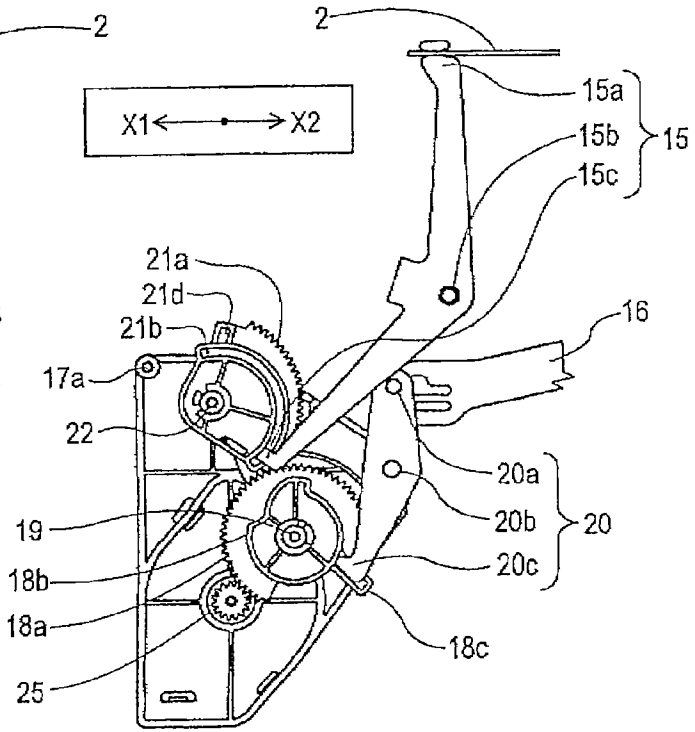
Figure 6A:
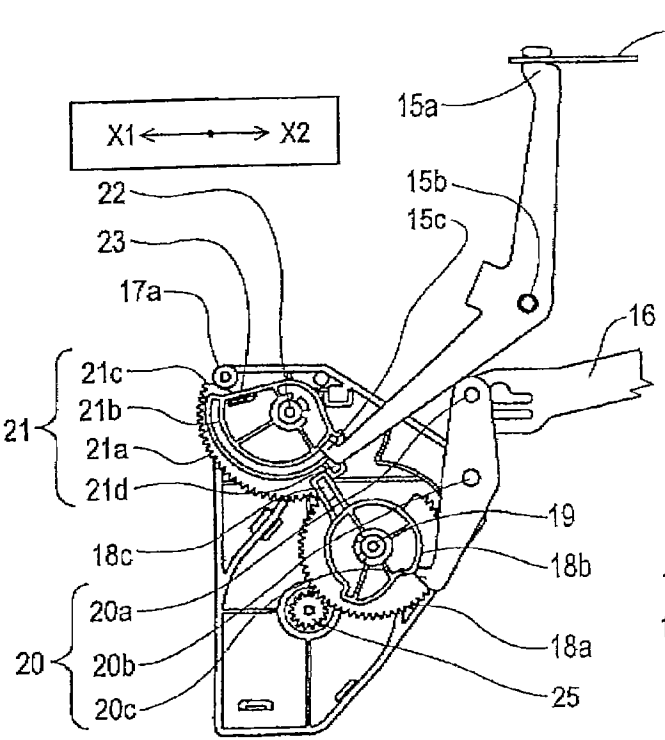

From this state, the shaft of the stepping motor 24 rotates to the position 26*e* (the cam lift amount of the cam portion 18*b* of the common gear 18) or 26*g* (the cam lift amount of the cam portion 21*b* of the thread loosening gear 21) (approximately 950°) in FIG. 7 and is stopped (FIG. 6B). By a change of the cam lift amount of the cam portion 21*b* of the thread loosening gear 21 from 26*d* to 26*g*, a thread loosening lever 15 rotates counterclockwise and the thread loosening rod 2 moves in the direction X1, Consequently, the left and right tension discs 4 and 5 are opened in a V shape on the lower side, and the upper thread tension is released. Since the cam lift amount of the cam portion 18*b* of the common gear 18 does not change from 0 mm, the state of the left-drop position is maintained.

Subsequently, when the user activates the sewing machine by pressing the foot controller to start sewing, the shaft portion of the stepping motor 24 (the pinion gear 25) rotates from the stop position 26*e* or 26*g* (approximately 950°) in FIG. 7 to a segment between 26*a* and 26*b*. In the course in which the common gear 18 rotates counterclockwise, and the state changes from the state in FIG. 68 to the state of FIG. 6A, and then to the state of FIG. 5B, engagement between the gear portion 18*a* of the common gear 18 and the gear portion 21*a* of the thread loosening gear 21 is firstly released, and then the lever portion 18*c* and the lever portion 21*d* are brought into contact with each other, and finally the contact therebetween is cancelled. Consequently, the thread loosening gear 21 rotates clockwise by the rotational torque of the return spring 23 until the surface 21*c* comes into contact with the stopper 17*a* of the bracket 17 and stops. By a change of the cam lift amount of the cam portion 21*b* of the thread loosening gear 21 from 26*g* to 26*d*, the thread loosening lever 15 rotates clockwise and the thread loosening rod 2 moves in the direction X2. Consequently, the left and the right tension discs 4 and 5 are closed and the upper thread tension is restored.

From FIG. 7, since a configuration in which the cam lift amount at the left-drop position in a segment between 26*d* and 26*e* at the time when the "upper thread tension adjusting mechanism" is operated is 0 mm is employed in the groove cam portion 21*b* of the thread loosening gear 21 in the example, the value of the load of the needle rod arm returning spring 13 is minimized. Consequently, a load torque of the stepping motor 24 is advantageously minimized. However, when there is enough room in a drive force and a drive speed of the stepping motor 24, cam profiles of the cam portion 18*b* of the common gear 18 and the cam portion 21*b* of the thread loosening gear 21 may be expanded by increasing the maximum value of the angle of rotation of the stepping motor to 1000° or more to add 2 mm of the cam lift amount for a center drop or 4 mm of the cam lift amount of a right-drop to the cam portion 18*b* of the common gear 18 in the segment from 26*e* (approximately 950°) to approximately 1000° or more. In this case, the thread loosening gear 21 is rotated until the tension of the upper thread is released (up to 950°), and then the needle rod 11 can be moved to a position where the user wants to. As a position where the user wants, for example, a reference position for the adjustment of the stitch width is determined from the left-drop position, the center-drop position, or the right-drop position depending on a sewing pattern that the user has selected. Consequently, a starting position of sewing can be confirmed accurately by turning a hand wheel before starting the embroidery, an improvement of convenience is achieved.

Effects and advantages

Since two mechanisms, namely, the "stitch width adjusting mechanism" and the "upper thread tension adjusting mechanism" are driven by a single stepping motor, the manufacture cost of the sewing machine body may be reduced, and a less expensive product is provided for the users. Since the motor for the "upper thread tension adjusting mechanism" is not necessary, the weight of the product may be reduced.

Furthermore, in the normal sewing state, the "stitch width adjusting mechanism" is not affected by mechanical factors. Since the drive force of the stepping motor is amplified in two steps by using the spur gear at the time when the "upper thread tension adjusting mechanism" is in operation, a stepping motor which is less expensive and has a small torque may be used. Even when the "upper thread tension adjusting mechanism" is broken down, the normal sewing is possible.

Since the lever portions 18*c* and 21*d* come into contact always with the same position before the two gears 21 and 18 are connected, an impact load between the gears is alleviated. Consequently, the durability is improved.

Embodiment 2

Since the sewing machine of Embodiment 2 basically has the same configuration as the sewing machine of Embodiment 1, description given below is focused on different points. Common members are denoted by common reference numerals as much as possible.

Figure 8:
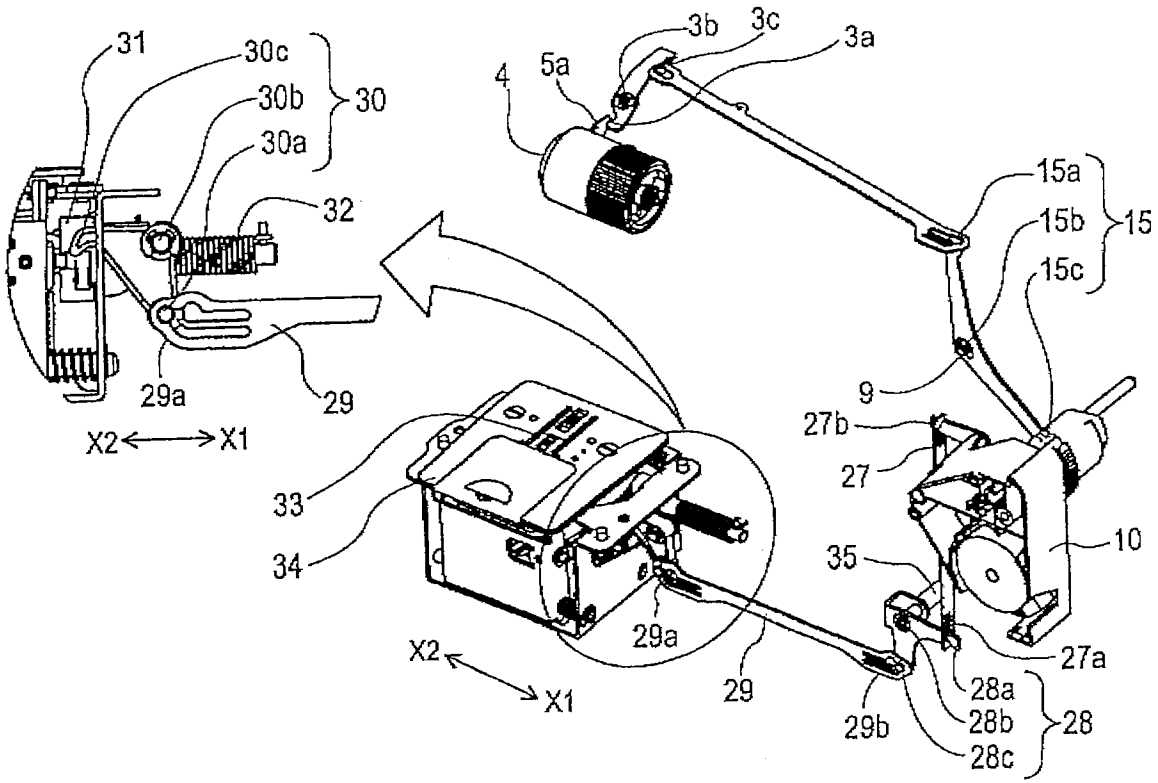
FIG. 8 is a schematic drawing illustrating a relationship among the common adjusting mechanism, the upper thread tension adjusting mechanism, and a feed amount adjusting mechanism of the sewing machine of Embodiment 2.
Figure 9B:
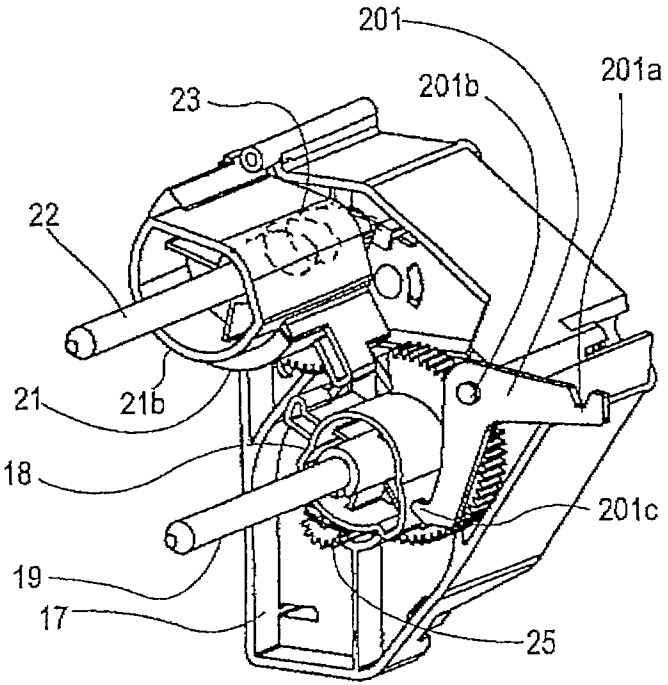
FIGS. 9A and 9B are schematic drawings illustrating a configuration of the stepping motor drive unit of the sewing machine of Embodiment 2.
Figure 9A:
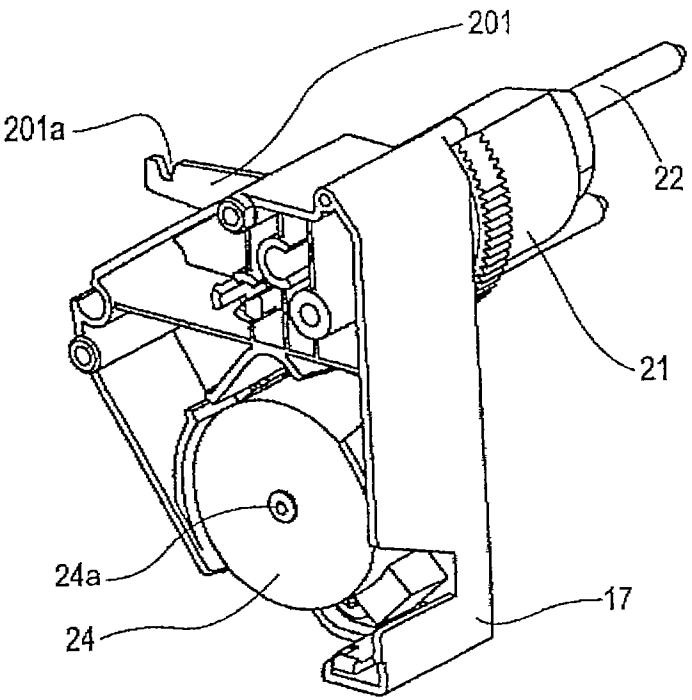
Figures 10A, 10B:
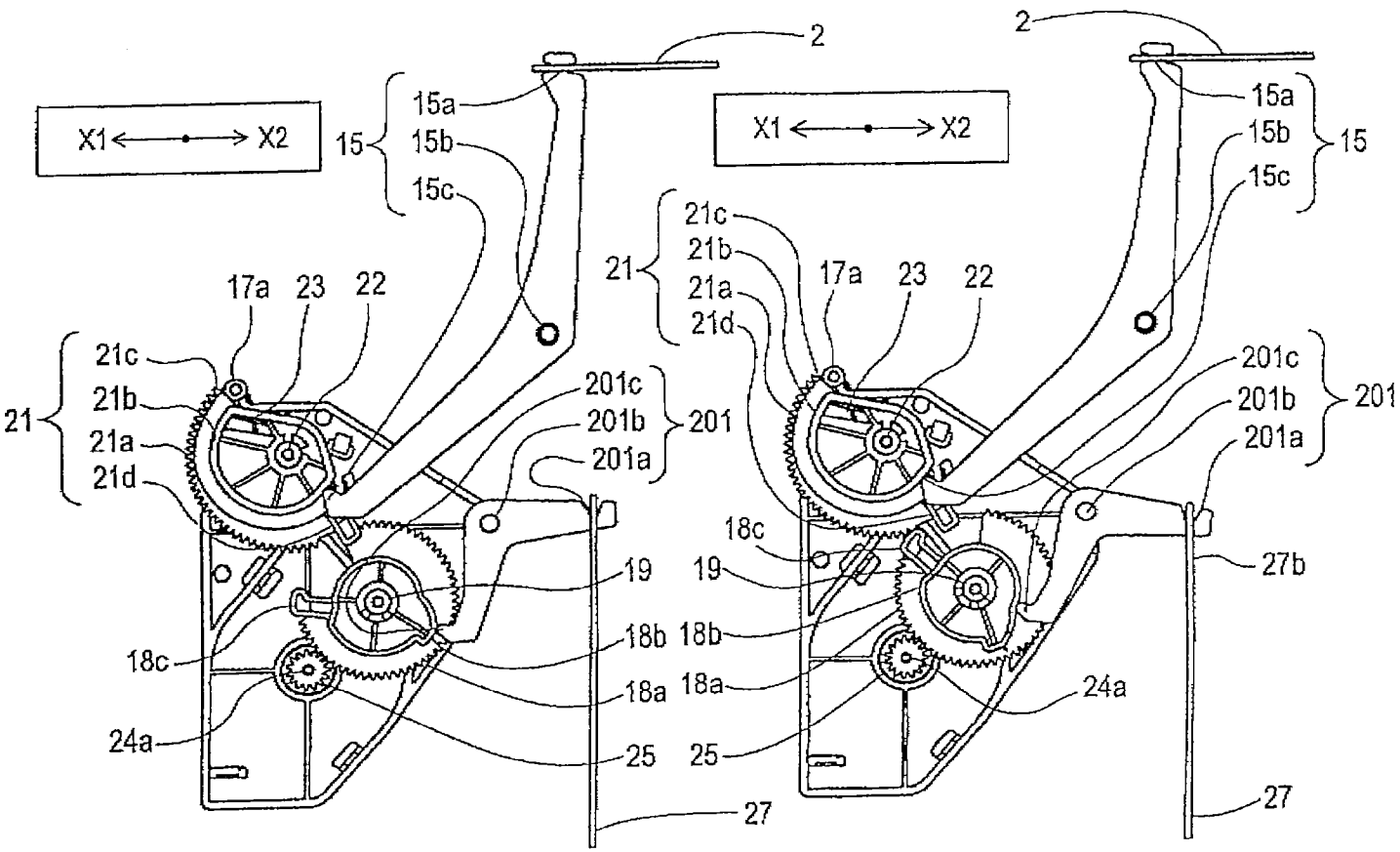

A sewing machine of Embodiment 2 as illustrated in FIG. 8 is different from Embodiment 1 in that a lever connecting portion 27*b* of a feed vertical rod 27 interlocked with a connecting portion 29*b* of a feed horizontal rod 29 is connected the end portion 20*a* of the stitch width lever of the common adjusting mechanism 10, while the lever connecting portion 16*b* of the stitch width rod 16 is connected thereto in Embodiment 1. The feed horizontal rod 29 is connected to a feeding mechanism and adjust the feed amount of the feeding mechanism. The stitch width rod 16 is connected to the stitch width adjusting mechanism, which is not disclosed in the drawing, and the stitch width thereof is adjusted.

The feed mechanism 26 includes a feed adjuster 31 configured to determine a fabric feed amount, the feed bell crank 30 configured to adjust the feed amount by coming into contact with and pressing the feed adjuster 31, and a feed adjustor spring 32 configured to urge (clockwise in FIG. 8, the direction toward 0 in feed amount) the feed bell crank 30. The feed mechanism 26 includes a mechanism which causes a feed teeth 33 to sink downward with respect to the needle plate 34 by the operation of the user (a drop-feed mechanism) integrated therein, which is used at the time of free-motion sewing. When the drop-feed mechanism is active, the fabric is not fed, and hence the feed mechanism 26 is disabled.

A crank connecting portion 29*a* of the feed width rod 29 is pivotably connected in a state of having a minute play at the rod connecting unit 30*a* of the feed bell crank 30. The feed bell crank 30 is constantly in contact with the feed adjuster 31 at a portion 30*c* (contact finger) that comes into contact with the feed adjuster 31. The feed bell crank 30 rotates about the center of rotation 30*b*, and hence the degree of pressing the feed adjuster 31 in contact therewith varies in accordance with the movement of the feed horizontal rod 29. Specifically, when the feed horizontal rod 29 moves in the direction X1, the feed bell crank 30 rotates counterclockwise, and presses the feed adjuster 31 leftward. When the feed horizontal rod 29 is moved in the direction X2, respective members move in the direction opposite to the case of moving in the direction X1, and hence the pressing amount is reduced.

The feed horizontal rod 29 is connected to the feed vertical rod 27 via a feed switching rod 28. The feed switching rod 28 is rotatably assembled to a shaft 35 fixed to the sewing machine frame 1 at the center of a rotation 28*b*. The connecting portion 29*b* of the feed horizontal rod 29 is pivotably connected to a horizontal rod connecting portion 28*c* of the feed switching rod 28 in a state of having a minute play. The connecting portion 27*a* of the feed vertical rod 27 is pivotably connected to a vertical rod connecting portion 28*a* of the feed switching rod 28. The connecting portion 27*b* of the feed vertical rod 27 is pivotably connected to the rod connecting portion 201*a* of the feed lever 201 which correspond to the stitch width lever 20 of Example 1. The configuration of the stepping motor drive unit 10 is the same as the sewing machine of Example 1 of other than that the stitch width lever 20 is replaced by the feed lever 201.

The drive force of the stepping motor drive unit 10 is transmitted to the feed adjuster 31 of the feed mechanism 26 by a link mechanism (a feed lever 201, the feed vertical rod 27, the feed switching rod 28, the feed horizontal rod 29, and the feed bell crank 30), and the sewing machine of the feed amount is changed.

When the feed horizontal rod 29 is moved in the X2 direction, the feed amount is changed to the forward feeding direction by the action of the feed adjustor spring 32, and when the feed horizontal rod 29 is moved in the direction X1, the feed amount is changed in the backward feed direction against the urging force of the feed adjustor spring 32.

The "feed amount adjusting mechanism" in a state of being used in the normal sewing of the second embodiment will be described. The pinion gear 25 and the gear portion 18*a* of the common gear 18 are always kept in an engaged state, and the drive power of the stepping motor 24 is transmitted and amplified. The gear portion 18*a* of the common gear 18 and the gear portion 21*a* of the thread loosening gear 21 are in a positional relationship of engagement. However, since part of the gear portion 18*a* has a notched shape, the gear portion 18*a* does not engage the gear portion 21*a* irrespective of the state (FIGS. 10A and 10B) in a range of adjustment (corresponding to the first range) of the feed amount at the time of normal sewing. In these states, the thread loosening gear 21 rotate clockwise by the rotational torque of the return spring 23, and a state in which the surface 21*c* is in contact with the stopper 17*a* of the bracket and hence is stopped is maintained.

In contrast, since the feed vertical rod 27 is always pulled downward by the action of the feed adjustor spring 32, the feed lever 20 rotates clockwise about the 20*b*, and the state in which the contact finger 20*c* is in contact with the cam portion 18*b* of the common gear 18 is maintained. Assuming that the angle of rotation of the stepping motor shaft portion 24*a* (the pinion gear 25) in a state in which the backward feed amount is maximized is 0° shown in FIG. 10A, the cam lift amount of the cam portion 18*b* of the common gear 18 is a value of 36*a* (the state illustrated in FIG. 10A: a maximum cam lift amount 4 mm, backward feed 4 mm), and a load applied to the shaft portion of the stepping motor 24 by the action of the feed adjustor spring 32 is also maximized. When the stepping motor shaft portion 24*a* (the pinion gear 25) rotates by approximately 160° from this state, the cam portion 18*b* of the common gear 18 also rotates, and the cam lift amount changes substantially linearly up to the value of 36*b* in FIG. 12 (a minimum cam lift amount 0 mm, forward feed 4 mm), and a state of a maximum feed amount (FIG. 10B) is achieved.

During this period, the feed bell crank 30 (see FIG. 8) rotates clockwise about 30*b* by the action of the feed adjustor spring 32, and the feed horizontal rod 29 is pulled in the direction X2, the feed lever 20 rotates clockwise about 20*b*, and a state in which the contact finger 20*c* is in contact with the cam portion 18*b* of the common gear 18 is maintained. Consequently, a value of a load on the shaft portion of the stepping motor 24 by the action of the feed adjustor spring 32 is minimized.

Figure 11A:
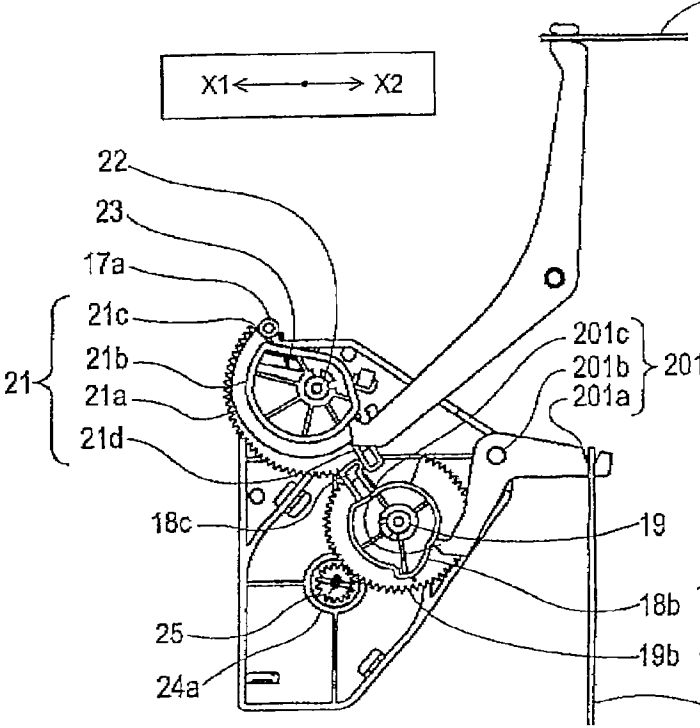
Figure 12:
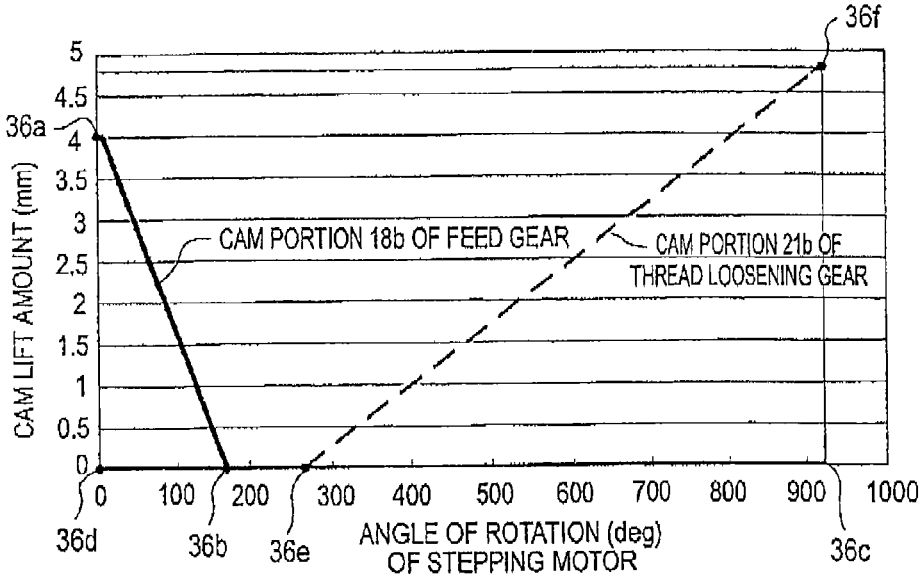
FIG. 12 is a graph showing the cam lift amount of the cam portion of the sewing machine of Embodiment 2.

An action of the "feed amount adjusting mechanism" when the sewing machine in the free-motion sewing mode is stopped will be described. The user operates the drop feed mechanism before the embroidery to cause the feed teeth 33 to sink with respect to the needle plate 34. When the user stops the sewing machine by returning the foot controller, the shaft portion of the stepping motor 24 (the pinion gear 25) rotates to a position 36*c* and 36*f* in FIG. 12 (approximately 920°). The position of 36*b* (approximately 160°) in this process corresponds to the state in FIG. 11A, and the common gear 18 rotates clockwise from the state of a maximum forward feed amount (FIG. 10B), and the lever portion 18*c* comes into contact with the lever portion 21*d* of the thread loosening gear 21 (FIG. 11A and 36*e* in FIG. 12). Furthermore, the common gear 18 rotates clockwise, and hence the lever portion 18*c* presses the lever portion 21*d* of the thread loosening gear 21 and the thread loosening gear 21 rotates counterclockwise. In time, the gear portion 18*a* of the common gear 18 and the gear portion 21*a* of the thread loosening gear 21 engage, and the drive force of the stepping motor 24 is transmitted and amplified via two steps of the spur gear.

Figure 11B:
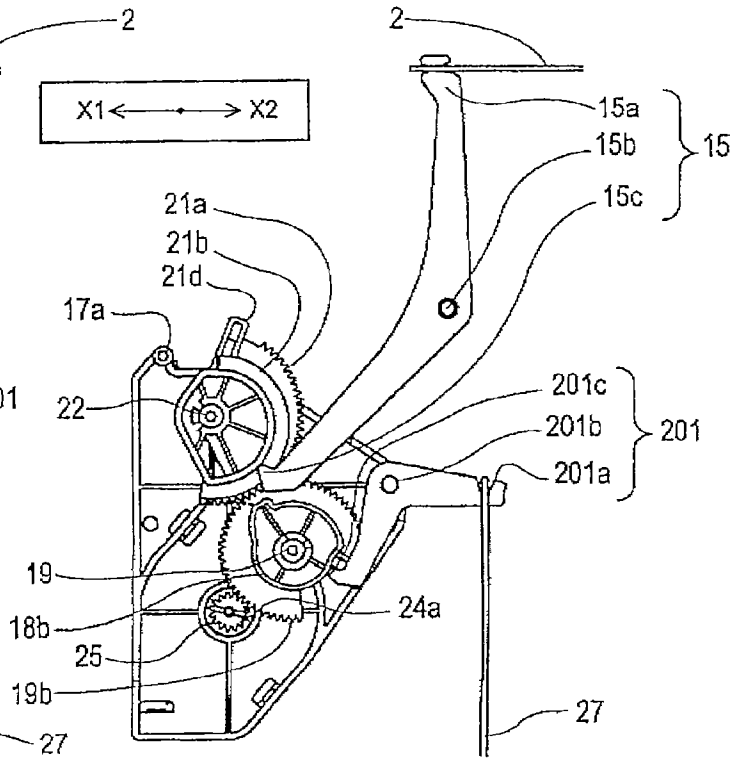

The state in which the shaft portion of the stepping motor 24 rotates to and is stopped at positions of 36*c* and 36*f* (approximately 920°) in FIG. 12 corresponds to FIG. 11B. By a change of the cam lift amount of the cam portion 21*b* of the thread loosening gear 21 from 36*e* to 36*f*, the thread loosening lever 15 rotates counterclockwise and the thread loosening rod 2 moves in the X1 direction. Consequently, the left and right tension discs 4 and 5 are opened in a V shape on the lower side, and the upper thread tension is opened.

When the user activates the sewing machine by pressing the foot controller, the shaft portion of the stepping motor 24 (the pinion gear 25) rotates from the stop position (approximately 920°) of 36*c* and 36*f* to a segment of 36*a* and 36*d* in FIG. 12. The common gear 18 rotates counterclockwise, and the state is changed to the state in FIG. 11B, the state in FIG. 11A, and the state in FIG. 10B. In the process of this change, an engagement between the gear portion 18*a* of the common gear 18 and the gear portion 21*a* of the thread loosening gear 21 is released, and the cam lift amount of the cam portion 21*b* of the thread loosening gear 21 changes from 36*c* to 36*d* in FIG. 12, so that the thread loosening lever 15 rotates clockwise and the thread loosening rod 2 is moved in the direction X2. Consequently, the left and right tension discs 4 and 5 are closed and the upper thread tension is restored. After the engagement between the gear portion 18*a* of the common gear 18 and the gear portion 21*a* of the thread loosening gear 21 has been released, the thread loosening gear 21 rotates clockwise by the rotational torque of the return spring 23, and a state in which the surface 21*c* is in contact with the stopper 17*a* of the bracket and hence is stopped is restored.

Figure 13:
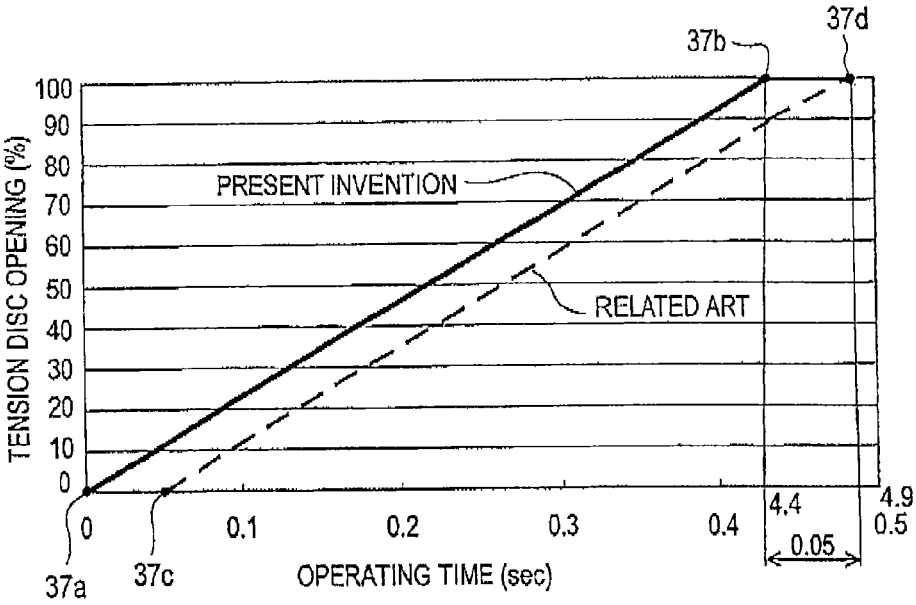
FIG. 13 is a graph illustrating a period required until the tension of the upper thread is released in the sewing machines of Embodiment 1 and Embodiment 2.

When comparing with the sewing machine of Example 1, as illustrated in FIG. 13, the tension of the upper thread of the sewing machine of Embodiment 2 is released quicker, so that the sewing object can be moved quickly without being affected by the tension of the upper thread. In the sewing machine of Embodiment 2, the load torque applied to the stepping motor shaft is minimized by setting the cam profile which moves the "feed amount adjusting mechanism" to the direction to maximize the forward feeding before operating the "upper thread tension adjusting mechanism", while in the sewing machine of Embodiment 1, the load applied to the shaft portion of the stepping motor is minimized by setting the cam profile which brings the "stitch width adjusting mechanism" to the left-drop position before operating the "upper thread tension adjusting mechanism". However, in the sewing machine of Embodiment 1, since the "stitch width adjusting mechanism" is used even during the free-motion sewing, time for changing the position of the shaft of the stepping motor 24 to the left-drop position after the stop of the sewing machine is necessary, and hence the time length until the upper thread tension is released is increased by the time length corresponding thereto (the length of the segment from 37*a* to 37*c* in FIG. 13 or the length of the segment from 37*b* to 37*d:* for example, 0.05 seconds).

In other words, in the sewing machine of the second embodiment, since the "feed amount adjusting mechanism" and the "upper thread tension adjusting mechanism" which are not used during the free-motion sewing are shared, and hence this mechanism may be used specifically for the "upper thread tension adjusting mechanism" during the free-motion sewing, so that the "upper thread tension adjusting mechanism" can be driven without time lug after the sewing machine has stopped. Since the "stitch width adjusting mechanism" is implemented by an independent mechanism, the user can select a desired position (left, center, or right) to stop the needle freely according to the method of embroidery.

(1) An aspect of this disclosure is directed to a sewing machine including: a needle rod on which a needle is mountable and configured to be reciprocated vertically; a pair of tension discs configured to sandwich an upper thread therebetween; a feed mechanism configured to transport a sewing object in a vertical direction; a reciprocating mechanism configured to reciprocate the needle rod laterally with respect to the vertical direction; an upper thread tension adjusting mechanism configured to adjust the tension discs by switching between an open state in which the tension of the upper thread is released, and a restored state in which the tension is restored; a feed amount adjusting mechanism configured to adjust a feed amount of the feed mechanism; a stitch width adjusting mechanism configured to adjust a stitch width of the reciprocating mechanism; and control means configured to control the upper thread tension adjusting mechanism, the feed amount adjusting mechanism, and/or the stitch width adjusting mechanism, wherein a common adjusting mechanism, which is one of the feed amount adjusting mechanism and the stitch width adjusting mechanism, includes: a motor; an adjusting mechanism body which is a tooth-missing gear whose teeth are partially missing and/or a cam and configured to be driven by the motor; a variation amount adjusting unit configured to change the variation amount, which is the feed amount of the feed mechanism or the stitch width of the reciprocating mechanism within a first range which is part of a movable range of the adjusting mechanism body by either one of a driven gear that engages the teeth of the tooth-missing gear or a driven member pushed by a cam surface of the cam, the upper thread tension adjusting mechanism includes: a thread loosening portion engaging the tooth-missing gear or pressed by the cam surface within a second range deviated from the first range in the adjusting mechanism body; and an upper thread tension adjusting unit configured to switch the tension discs from the restored state to the open state in conjunction with the thread loosening portion, and the control means performs an opening action that switches the tension discs to the open state by changing the adjusting mechanism body in the second range when the common adjusting mechanism does not have to perform an adjustment of the variation amount, and when the tension disc needs to be opened.

Simplification of the adjusting mechanism which is a principal cause of an increase in cost or number of components is succeeded. Specifically, the function of the upper thread tension adjusting mechanism is integrated with one of the feed amount adjusting mechanism and the stitch width adjusting mechanism. When the upper thread tension adjusting mechanism is operated, the operations of the feed amount adjusting mechanism and the stitch width adjusting mechanism may be avoided, so that the both may be controlled independently even though they are integrated.

The aspect of this disclosure described in (1) may employ one or more of configurations (2) to (4) arbitrarily.

(2) A feed mechanism switching apparatus configured to switch the state between a state of feeding the sewing subject and a state of not feeding the sewing subject and is configured to be controlled by the control unit is provided, and the control means switches the feed mechanism to the state not feeding the sewing object by the feed mechanism switching apparatus at the time of free-motion sewing, which is one of modes of doing embroidery on the sewing object to perform the opening action.

(3) The tooth-missing gear includes a tooth-missing gear lever interlocked therewith, and the driven gear engaging the tooth-missing gear includes a driven gear lever configured to come into contact with the tooth-missing gear immediately before engagement of the teeth of the tooth-missing gear with the teeth of its own so that power is transmitted from the tooth-missing gear.

(4) The adjusting mechanism body is means configured to unify the tooth-missing gear and the cam coaxially and rotate the same, The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A sewing machine comprising:

a needle rod on which a needle is mountable and configured to be reciprocated vertically;

a pair of tension discs configured to sandwich an upper thread therebetween;

a feed mechanism configured to transport a sewing object in a vertical direction;

a reciprocating mechanism configured to reciprocate the needle rod laterally with respect to the vertical direction;

an upper thread tension adjusting mechanism configured to adjust the tension discs by switching between an open state in which the tension of the upper thread is released, and a restored state in which the tension is restored;

a feed amount adjusting mechanism configured to adjust a feed amount of the feed mechanism;

a stitch width adjusting mechanism configured to adjust a stitch width of the reciprocating mechanism; and a control apparatus configured to control the upper thread tension adjusting mechanism, the feed amount adjusting mechanism, and/or the stitch width adjusting mechanism, wherein a common adjusting mechanism, which is one of the feed amount adjusting mechanism and the stitch width adjusting mechanism, includes:

a motor;

an adjusting mechanism body which is a tooth-missing gear whose teeth are partially missing and/or a cam and configured to be driven by the motor; and a variation amount adjusting unit configured to change the variation amount, which is the feed amount of the feed mechanism or the stitch width of the reciprocating mechanism within a first range which is part of a movable range of the adjusting mechanism body by either one of a driven gear that engages the teeth of the tooth-missing gear or a driven member pushed by a cam surface of the cam;

the upper thread tension adjusting mechanism includes:

a thread loosening portion engaging the tooth-missing gear or pressed by the cam surface within a second range deviated from the first range in the adjusting mechanism body; and an upper thread tension adjusting unit configured to switch the tension discs from the restored state to the open state in conjunction with the thread loosening portion, and the control apparatus performs an opening action that switches the tension discs to the open state by changing the adjusting mechanism body in the second range when the common adjusting mechanism does not have to perform an adjustment of the variation amount, and when the tension discs need to be opened.

2. The sewing machine according to claim 1, comprising a feed mechanism switching apparatus configured to switch the feed mechanism between a state of feeding the sewing object and a state of not feeding the sewing object and configured to be controlled by the control apparatus, wherein the control apparatus switches the feed mechanism to the state not feeding the sewing object by the feed mechanism switching apparatus at the time of free-motion sewing, which is one of modes of doing embroidery on the sewing object to perform the opening action.

3. The sewing machine according to claim 1, wherein the tooth-missing gear includes a tooth-missing gear lever interlocked therewith, and the driven gear engaging the tooth-missing gear includes a driven gear lever with which teeth of the tooth-missing gear comes into contact immediately before engagement of the teeth of the tooth-missing gear with the teeth of its own and to which power is transmitted from the tooth-missing gear.

4. The sewing machine according to claim 1, wherein the adjusting mechanism body is an apparatus configured to unify the tooth-missing gear and the cam coaxially and rotate the same.

* * * * *